US006076185A

United States Patent [19]

Schramm

[11] Patent Number: 6,076,185

[45] **Date of Patent: *Jun. 20, 2000**

[54] PROTECTIVE PAD FOR THE UPPER ARM AND FOREARM OF A PERSON, IN PARTICULAR OF AN ATHLETE

[75] Inventor: Günther Schramm, Dachau, Germany

[73] Assignee: Schramm Sport GmbH, KWON-Kampfsportausstattung, Vierkirchen, Germany

[ * ] Notice: This patent is subject to a terminal disclaimer.

[21] Appl. No.: 09/236,563

[22] Filed: Jan. 26, 1999

Related U.S. Application Data

[63] Continuation-in-part of application No. 08/980,905, Dec. 1, 1997, Pat. No. 5,898,939.

[30] Foreign Application Priority Data

Jul. 13, 1998 [DE] Germany ..... 298 12 450

[51] Int. Cl.[7] ..... A41D 13/00

[52] U.S. Cl. ..... 2/16; 2/455; 128/878; 602/62

[58] Field of Search ..... 2/22, 24, 16, 62, 2/455; 602/20, 23, 26, 27, 62, 65; 128/878, 881, 882

[56] References Cited

U.S. PATENT DOCUMENTS

| | | | |
|---|---|---|---|
| 1,624,129 | 4/1927 | Barrett . | |
| 2,902,779 | 9/1959 | Cook . | |
| 3,416,156 | 12/1968 | Marvid . | |
| 3,475,835 | 11/1969 | Kovar . | |
| 3,908,645 | 9/1975 | Sandvig . | |
| 4,190,902 | 3/1980 | Rhee | 2/16 |
| 4,497,070 | 2/1985 | Cho . | |
| 4,633,529 | 1/1987 | Litz . | |
| 4,692,946 | 9/1987 | Jurga . | |
| 4,876,745 | 10/1989 | Richards . | |
| 5,507,720 | 4/1996 | Lampropoulos . | |
| 5,711,028 | 1/1998 | Bourque et al. . | |
| 5,715,535 | 2/1998 | Hamilton et al. | 2/59 |
| 5,732,411 | 3/1998 | Coleman et al. . | |
| 5,742,938 | 4/1998 | Winningham et al. . | |
| 5,898,939 | 5/1999 | Schramm | 2/22 |

FOREIGN PATENT DOCUMENTS

| | | |
|---|---|---|
| 1744809 | 3/1957 | Germany . |
| 8030463 | 3/1981 | Germany . |
| 8403767 | 7/1984 | Germany . |

*Primary Examiner*—John J. Calvert
*Assistant Examiner*—Tejash Patel
*Attorney, Agent, or Firm*—Evenson, McKeown, Edwards & Lenahan, P.L.L.C.

[57] ABSTRACT

The subject matter of the invention is a protective device for the upper arm and forearm of a person, particularly of an athlete, with an upper arm part (3) and a forearm guard (2) in which to ensure the protection of the zone between the upper arm and the forearm without any impediment to the person, the upper arm part (3) and/or the forearm guard (2) possess(es) a tongue-like extension (31, 21).

21 Claims, 5 Drawing Sheets

Figure 1:
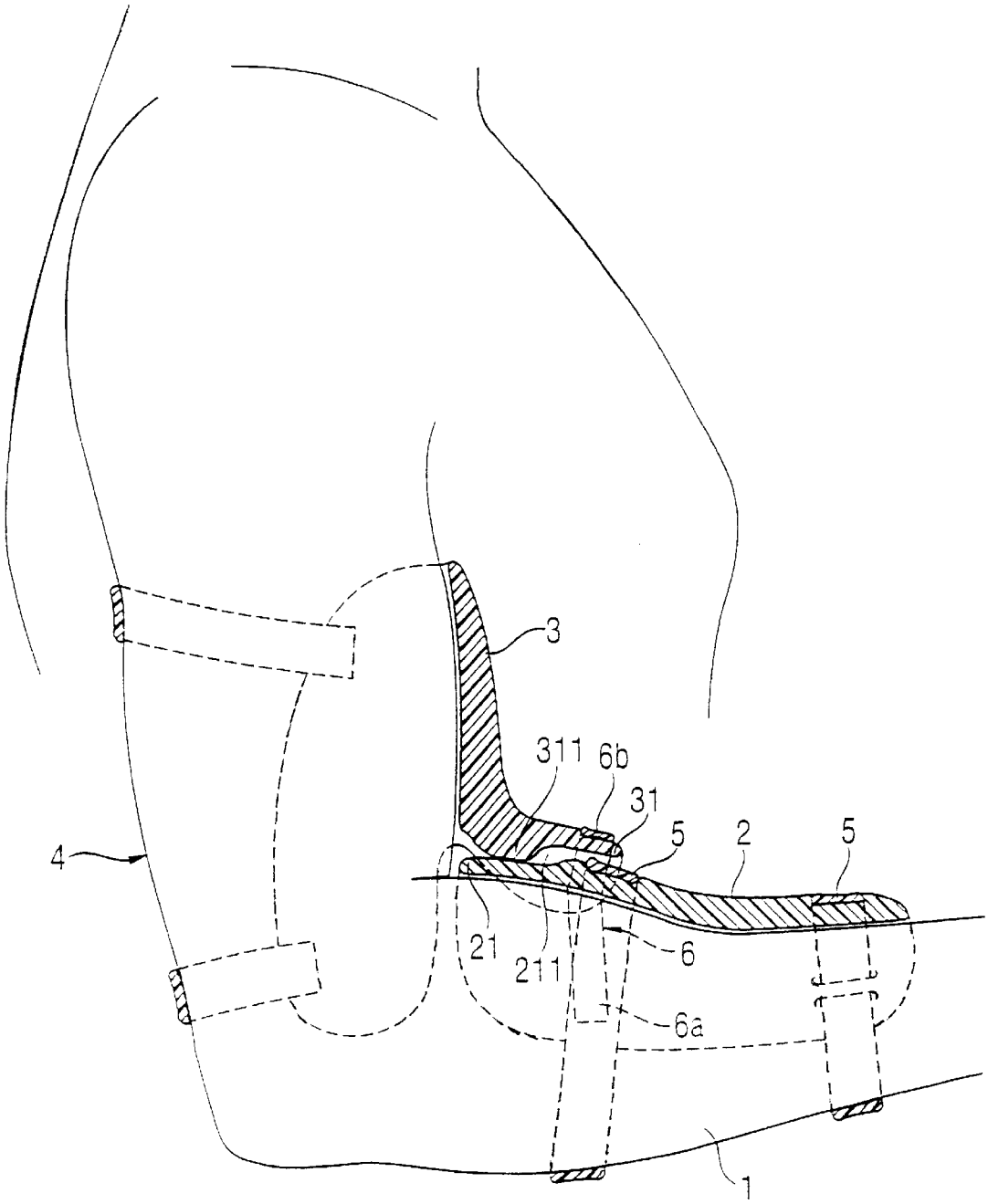

PROTECTIVE PAD FOR THE UPPER ARM AND FOREARM OF A PERSON, IN PARTICULAR OF AN ATHLETE

This application is a continuation-in-part of U.S. application Ser. No. 08/980,905, filed Dec. 1, 1997, now U.S. Pat. No. 5,898,939.

DESCRIPTION

The invention relates to a protective pad for the upper arm and forearm of a person, in particular of an athlete, with an upper arm part and a forearm guard.

In various types of sports, an unimpeded movement of the elbow joint is an elementary, basic requirement for the optimum exercise of the sport. At the same time, in my of these types of sports, there is a special risk of injury in the elbow joint area due to actions of an opponent or team mate or from bats used by the players in the exercise of their sport. This risk of injury requires a special pad, but such a pad in the elbow joint area is a hindrance to mobility in all solutions practiced hitherto.

In many types of competitive sports between two opponents, in soccer and in hockey, the area at the front side of the elbow joint is at risk, particularly in direct challenges. For this reason, in competitive sports between two opponents, at least the forearm area is padded with forearm guards and the upper arm by upper arm guards.

However, between the upper arm and the forearm, there remains practically always a particularly endangered area around the elbow. Continuous pads which completely cover the endangered areas in every situation from the hand up to the upper part of the upper arm are, however, at least unusual. For such a continuous pad would be compressed when the arm is raised due to the shortening of the inside tendon in the elbow joint area and, in contrast, tautened when the arm is extended. Both processes at least involve an effort which impairs the movement of the arm and are therefore not accepted in competitive sports where one always has to give 100%.

Generally, therefore, the protective pad for the upper arm area and the pad for the forearm are two separate parts which are maximally positioned at such a close distance to each other that with the forearm maximally raised they just contact each other above the elbow. However, this means that with the arm extended, a distance opens up in the order of around 5 cm between the tipper arm pad and the forearm pad. As a result, a very sensitive and endangered body part is unprotected just in direct challenge situations, for it is just then that the arm is often extended fully.

It is the object of the invention to propose a protective pad of the type first described with which the protection of that area between the upper arm and the forearm can be ensured without any impediment to the person or athlete.

This object is solved in accordance with the invention by the upper arm section and/or the forearm guard possessing a tongue-like extension.

In accordance with the principle of the invention, the protective pads for the upper arm and forearm overlap on the front side of the upper arm or forearm in any contest or game situation. The overlap is only a minimum amount when the arm is extended, that is when the tendon above the elbow joint is at maximum extension. The overlap is maximal when the forearm is raised up. For this purpose, either a tongue-like extension is located in the direction of the forearm at the upper arm section or at the protective pad on the upper arm side or a tongue-like extension is located at the forearm guard towards the upper arm. However, it in also possible for both pads, that is the upper arm section and the forearm guard, to possess one tongue-like extension each—generally shorter in this case—which extensions overlap. In this way, protection of the area between the upper arm and forearm is ensured in every contest or game situation. At the same time, it is ensured that the athlete is not impeded by the protective pad in accordance with the invention.

It is possible to provide a first tongue-like extension on the forearm guard and a second tongue-like extension on the upper arm section.

A further advantageous embodiment is characterized in that a first tongue-like extension is provided on the upper arm section and a second tongue-like extension on the forearm guard. In accordance with this proposal, primarily a (first) tongue-like extension is fixed on the upper arm section of the protective pad. The (second) tongue-like extension on the forearm guard is preferably shorter. By means of the advantageous embodiment described, it is made possible to use the forearm guard either independently of the compatible upper arm protection pad or with any conventional protection suitable for the relevant type of sport. The function of the system in accordance with the invention is described accordingly below. In general, however, the system is also applicable to the reverse situation with a (somewhat longer first) tongue-like extension on the forearm guard (and a shorter second tongue-like extension on the upper arm section).

Preferably, the upper arm section is formed as an upper arm guard. It is furthermore advantageous to design the first tongue-like extension to be longer than the second tongue-like extension.

In any case, it is advantageous if the tongue-like extension or the tongue-like extensions are designed to be easily flexible. For the tongue-like extension must adapt to the very tight radius when the arm is raised and to the almost flat transition from the upper arm to the forearm when the upper arm is extended. Preferably the tongue-like extension is formed as a soft foam protective pad. Such a soft foam protective pad meets the requirements described.

There are basically two possibilities for the overlap:

(1) The tongue or the tongue-like extension of the upper arm section slides underneath the forearm guard. In this case, it is advantageous if the forearm guard possesses a tunnel-like concavity which matches the cross-section of the tongue and inside of which the tongue-like extension can slide lengthways. The guidance of the tongue or the tongue-like extension is ensured in a perfect manner as it is guided on all sides between the body surface and the tunnel walls.

(2) The tongue or the tongue-like extension of the upper arm section slides over the forearm guard. It appears advantageous, also in this embodiment, to provide a guidance device. Such a guidance device may, for example, comprise a rail-like recess in the longitudinal direction of the forearm guard and a matching sled-like fixture on the inside of the tongue-like extension, each in the overlap zone. In this embodiment, the tongue-like extension is naturally not guided on all sides, but only on three sides. It is thus not prevented from being bent away from the surface of the forearm guard into air. In accordance with the invention, however, this bending away, which would lead to unacceptable functional impairments, should be definitely prevented. If the tongue-like extension should always contact the surface of the arm or the forearm guard, it must still be pressed against the upper arm and forearm guard with a not negligible pressure when the arm is in the furthest extended position so that it does not flap uncontrollably during the fast arm movement in the practicing of the sport. To guarantee this, in accordance with an advantageous embodiment of the invention, it is proposed to design the inherent arching of the tongue-like extension in such a way that it is lower than the arching of the arm top in its furthest extended position.

However, as a result, the pressure in the most bent position, that is when the arm is raised, is very high due to the high bending stress in the tongue or the tongue-like extension. This produces relatively high friction between the tongue-like extension and the forearm guard. Due to this high friction, jams may occur which may well prevent a free sliding when the arm is raised. Furthermore, it must be assumed that the tongue or the tongue-like extension will gradually be subject to fatigue due to the repeated bending stress in use with the consequence that after longer use it will then after all tend to hang away from the arm. If it then receives a punch or push from above in a challenge action, so that it is compressed or bent away, the arrangement will quickly become unusable. To prevent this, a further advantageous embodiment is characterised in that the tongue or the tongue-like extension and the forearm guard are connected by an elastic strap. This system is designed in such a way that the tongue-like extension is always pulled to the forearm guard by an elastic strap. The tongue-like extension is pulled to the forearm guard relatively strongly in the extended arm position. In the bent arm position (that is with the tip of the arm raised up), the tongue-like extension is pulled to the forearm guard relatively weakly by the elastic strap. The inherent arching of the tongue-like extension is set tightly and based on the minimum possible radius of the upper arm/forearm transition. The tongue-like extension is thus not pressed on the forearm guard at all by its own tension. There is no danger that the tongue will stand away from the arm after a certain time due to fatigue.

Advantageously, the protective pad is made from a plastic, preferably an ethylene/vinyl acetate copolymer.

Figure 4:
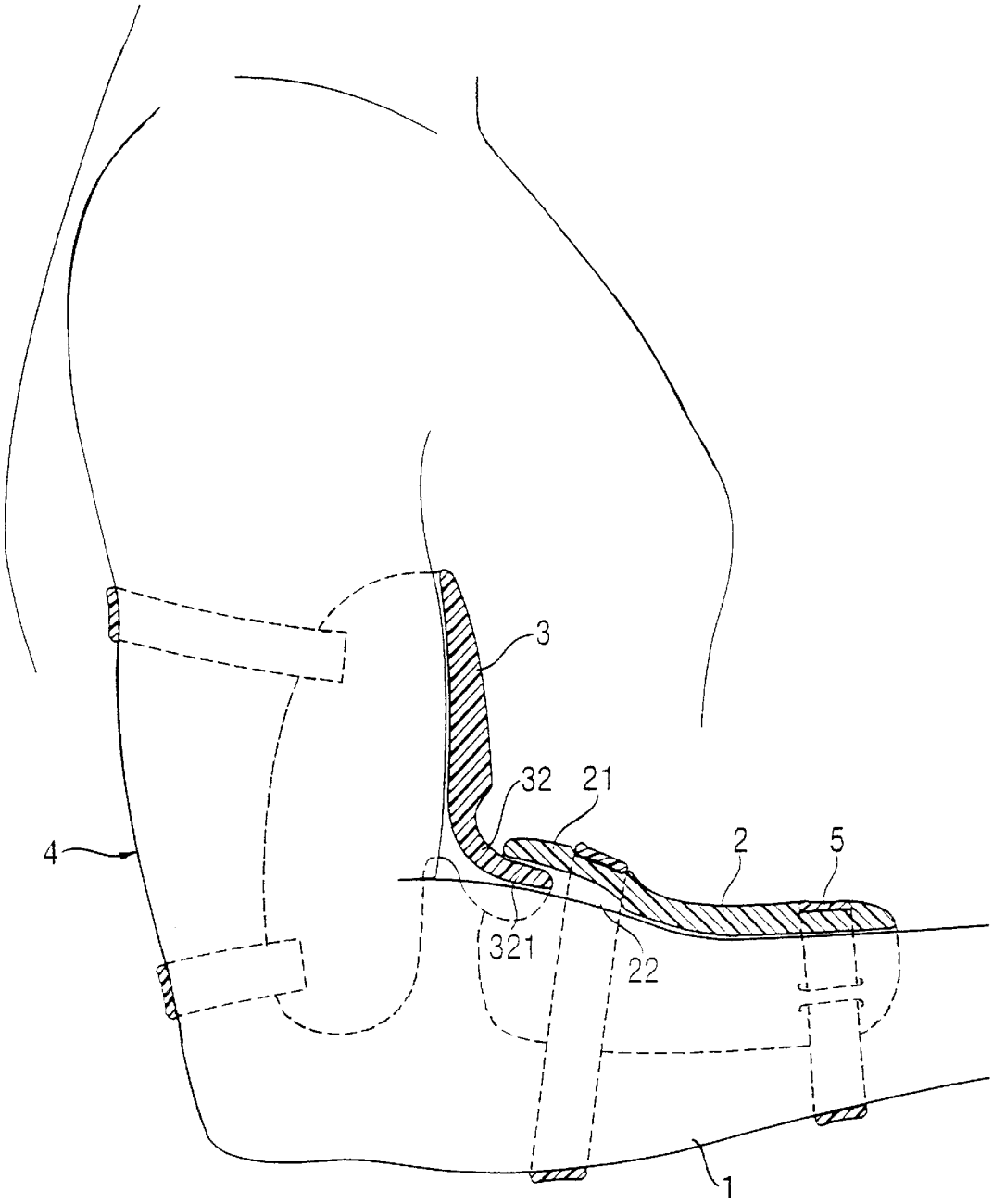
Figure 5:
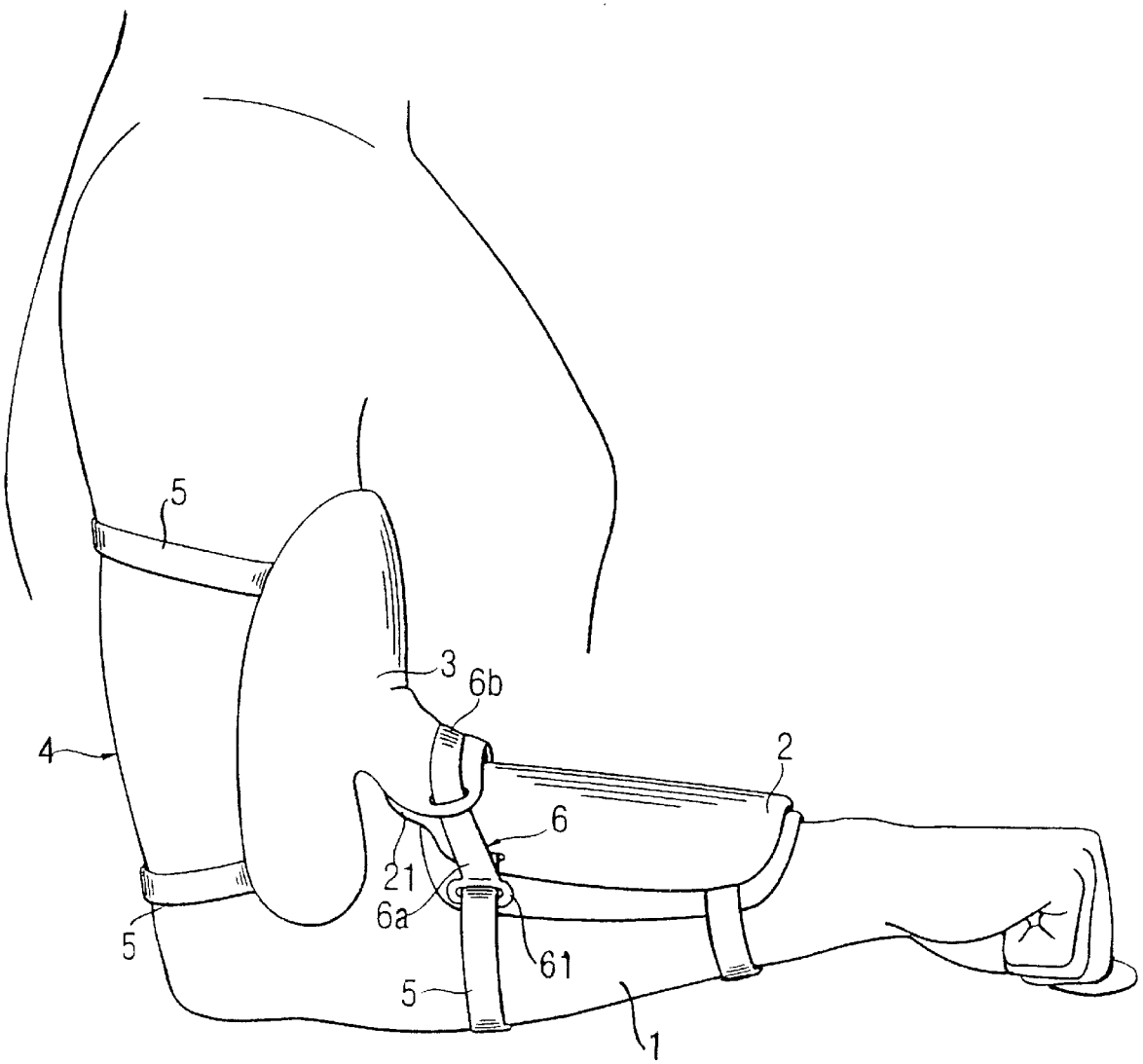

Embodiments of the invention are described below in detail by means of the attached drawings. In the drawings FIG. 1 shows a protective pad for upper arm and forearm in a lateral cross-section, FIG. 2 shows the pad from FIG. 1 with an extended forearm, FIG. 3 shows the pad from FIGS. 1 and 2 with a raised forearm, FIG. 4 shows a modified embodiment of a protective pad for upper arm and forearm, in bent position, and FIG. 5 shows an overall view in perspective of the entire upper arm and forearm guard in bent position.

Figure 2:
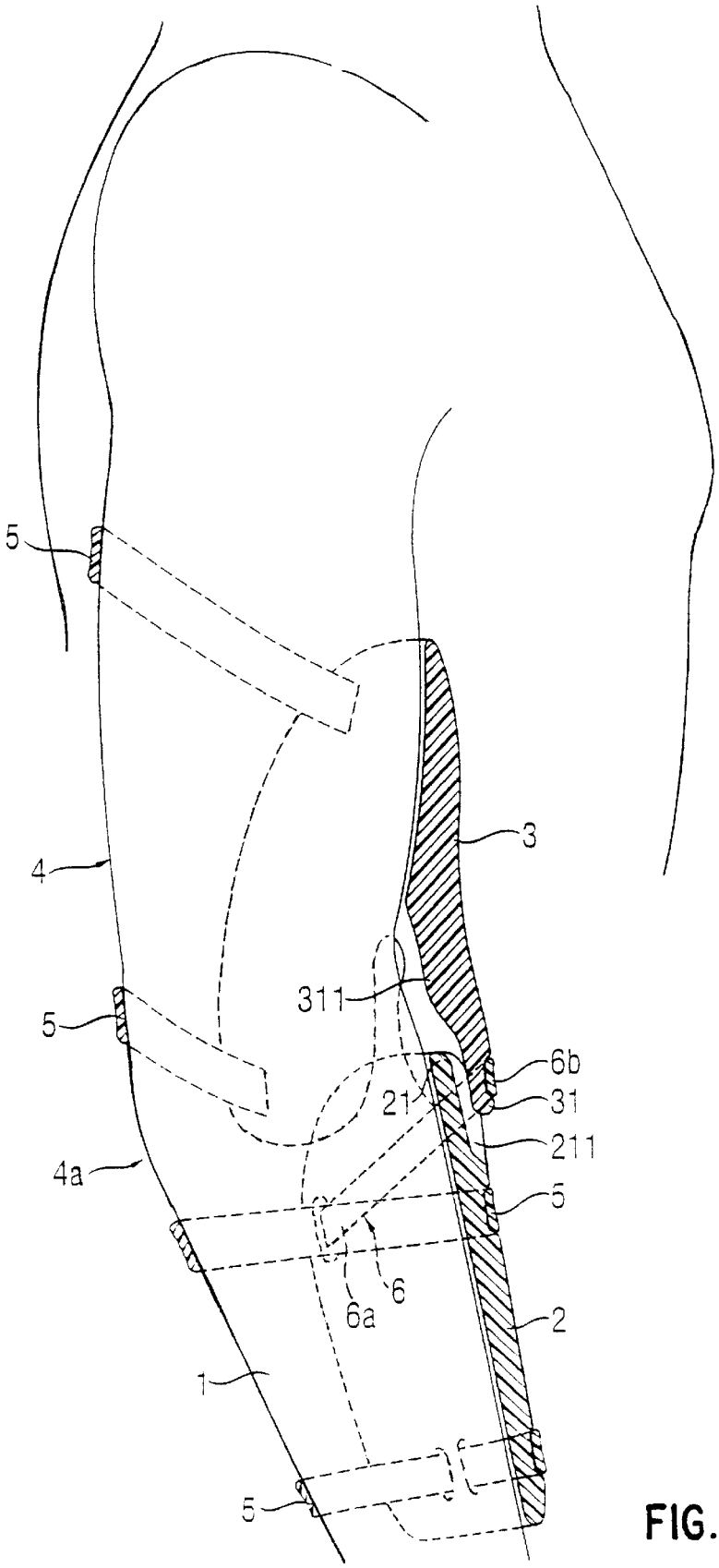
Figure 3:
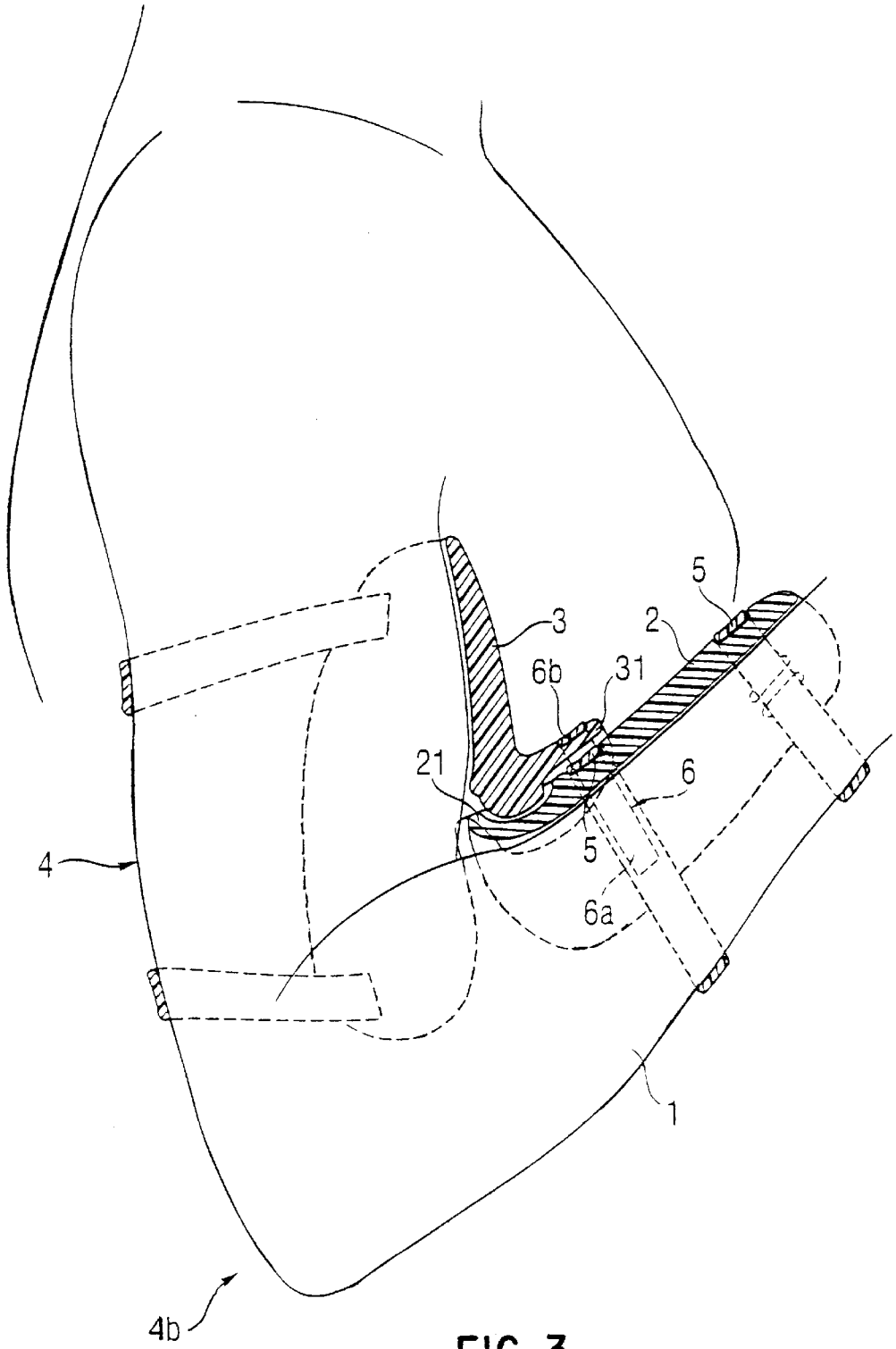

As shown in FIGS. 1 to 3, the protective pad for the upper arm and forearm of an athlete comprises an upper arm section 3 and a forearm guard 2. The forearm guard 2 basically designed in a conventional manner is fitted as usual to the forearm 1 of the athlete by means of retaining straps 5. The forearm guard 2 shown only differs from a normal forearm guard by a tongue-like extension 21 which connects upward roughly to the centre (when viewed from the front) of the forearm guard above the actual protection zone. The tongue-like extension 21 is designed to be so short that the function as a conventional forearm guard (without the associated upper arm guard 3) is not impaired.

The tongue-like extension 21 is very thin over a substantial portion of its width and is so designed for a soft bending. This contributes quite substantially to it not being an irritant during sports activities. The tongue-like extension 21 contains a rail-like recess 211, which takes up the greater part of its total width and which at its base leaves over only a small part of the wall thickness of the protective pad.

Basically, this tongue-like extension 21 could be avoided if the tongue-like extension 31 of the upper arm guard 3 were extended accordingly and the rail-like guidance device transposed into the actual protection zone. However, there, the rail-like recess 211 would detract from the protective effect. It would then be necessary either to make the rail-like recess 211 very narrow or to divide it up into two or more spaced narrow single rails or it would be necessary to increase the base wall strength of the forearm guard 2 at the point of the rail-like recess 211 by so much that the forearm guard 2 would still meet the protection requirements despite the recess. These measures would, however, make the overall construction very thick and very over-dimensioned in interaction with the tongue 31 of the upper arm guard 3, for then the tongue 31 would also come to rest on top of the protective zone or the forearm guard 2 already made thicker in the rail zone. For these reasons, it is advantageous to provide the tongue-like extension 21 as shown in FIGS. 1 to 3.

The tongue-like extension 31 of the upper arm guard 3 overlaps the tongue-like extension 21 of the forearm guard 2 and its upper central zone. On the inside of the tongue-like extension 31 of the upper arm guard 3, a slide-like elevation 311 is located which fits with sufficient tolerance to the rail-like recess 211 in the tongue-like extension 21 of the forearm guard 2. The slide-like elevation 311 can be formed as a separate component and connected with the tongue-like extension 31. However, it is also possible to form the slide-like elevation 311 integrally with the tongue-like extension 31. The longitudinal extensions of the rail-like recess 211 and of the essentially equally long slide-like elevation 311, which can also be described as a slide-like fitting, are dimensioned in such a way that with the arm 4*a* fully extended the slide-like elevation 311 is still guided in the rail (FIG. 2) and that the slide-like elevation 311 does not yet contact the end of the rail 211 with the arm 4*b* fully raised (FIG. 3).

The length of the tongue-like extensions 31, 21 at the upper arm guard 3 and at the forearm guard 2 are dimensioned in such a way that even when the arm is fully extended, at least the rail-like recess 211 is still covered. The length of the tongue-like extension 31 of the upper arm guard 3 must therefore be at least roughly twice as long as the length of the slide-like elevation 311 on the inside of the tongue-like extension 31. The length of the tongue-like extension 21 on the forearm guard 2 is, in contrast, only as long as the length of the rail-like recess 211 or even shorter when this rail-like recess 211 still dips a little into the circumference of the actual forearm guard 2.

The slide-like elevation could also rest on the tongue-like extension of the forearm guard 2. In this case, the associated, compatible recess would be provided on the inside of the tongue-like extension on the upper arm guard 3. As, however, the tongue-like extension on the forearm guard 2 should rather be thin and flexible, while the tongue-like extension on the upper arm guard 3 should rather be stable, this version is possible, but less preferred.

The tongue on the upper arm guard 3 is preferably highly arched, preferably approximately as much as the radius of the arm bend when the forearm is raised to the maximum (FIG. 3), but possibly also even more. This has the consequence that the tongue-like extension 31 only contacts the forearm guard 2 without pressure when the forearm is fully raised (FIG. 3), while standing off in every other arm position. Near to the upper end of the tongue-like extension 31, an elastic strap 6 is fitted which runs round the tongue 31. It is also possible to have two single elastic straps symmetrically at both sides of the tongue 31. The two ends 6*a*, 6*b* of the wound strap or the free end in each case of the two single straps are fixed to the forearm guard 2, This can be done in accordance with FIG. 5 such that the lower retaining straps 5 of the forearm guard 2 are simply thread through eyelets 61 at the free ends 6*a* of the elastic strap 6 or the elastic straps.

The length and tautness of the elastic strap or straps are adjusted so that the tongue 31 on the upper arm guard 3 is pulled to the forearm guard 2 against its arching and is pressed against it in every position at least with low tension.

In an arrangement as in FIGS. 1 to 3, it can be achieved that the contact pressure of the tongue 31 is very uniform in every position of the arm 4 and so is never so high that the tongue 31 gets caught as a result of high friction. With the arm fully extended 4*a* (FIG. 2), the elastic strap 6 or the elastic straps are extended so much that they exert a correspondingly high force on the tongue 31. This high force is wanted as the tongue 31 has to be pulled almost flat and so highly deformed. With the arm raised high 4*b* (FIG. 3), in contrast, the elastic strap or the elastic straps are shortened as much as possible so that they can only exert a low force which, however, is sufficient, for the tongue 31 contacts the forearm guard 2 under its own force with its inherent arching in this position.

In this arrangement, it has been provided that the tongue 31 is always pulled upwards with a certain component by the elastic strap in every position of the arm 4, 4*a*, except with a maximally raised forearm 4*b*, which effectively supports the raised forearm 4*b*, which effectively supports the sliding of the slide-like elevation 311 in the rail 211.

In the embodiment shown in FIG. 4, the special feature comprises the fact that the tongue 32 of the upper arm guard 3 can slide lengthways in a tunnel-like concavity 22 on the inside of the forearm guard 2. In this embodiment, the elastic straps are not required. However, in this arrangement, it must be ensured that the tongue 32 cannot jam in the tunnel 22. The risk of jamming is increased if the forearm guard 2 is fitted very tightly and the tunnel volume is thus reduced. The sure function is ensured when the forearm guard material is sufficiently rigid, when the cross-section of the tongue 32 is relatively small and when the tongue 32 has sufficiently large play in the tunnel-like concavity 22.

In this embodiment, the volume of the slide 321 which can slide in the tunnel-like concavity 22 is identical to the volume of the tongue-like extension 32 of the upper arm guard 3. This limits the thickness and extension of the tongue-like extension 32 in comparison to the embodiment from FIGS. 1 to 3 where the extension and thickness and so the padding in the transition from the upper arm to the forearm can be chosen absolutely freely.

In accordance with FIG. 4, it may be appropriate to support the eliding of the tongue 32 in the tunnel-shaped concavity 22 by connecting the end of the tongue 32 with the inside of the forearm guard 2 at the end of the concavity 22 by means of an elastic strap (not shown in the drawing). The elastic strap is best connected to the forearm guard 2 with velcro. It must have sufficient expansion movement available to follow the total movement of the arm with a low increase in force.

The upper arm and forearm guard according to the invention also can be connected to a hand guard. Thus the tongue-like extension 21 of the forearm guard 2 can pass into or continue in the padding of a hand guard. Furthermore the connection can be effected through an extension of the forearm guard under the fastening of the hand guard on the arm.

What is claimed is:

1. A protective pad for the upper arm and forearm of a person, particularly of an athlete, comprising:

an upper arm section, and a protective forearm guard, wherein at least one of the upper arm section and the protective forearm guard possesses a protective tongue-like extension which overlaps and slides relative to the other of the upper arm section and the protective forearm guard such that a front side area between the upper arm and the forearm of the person is protected independent of whether the arm of the person is extended or flexed.

2. A protective pad according to claim 1 wherein a first protective tongue-like extension is provided on the protective forearm guard and a second protective tongue-like extension is provided on the upper arm section.

3. A protective pad according to claim 2 wherein the first protective tongue-like extension is longer than the second protective tongue-like extension.

4. A protective pad according to claim 2 wherein at least the first protective tongue-like extension is formed as a soft foam protective pad.

5. A protective pad according to claim 2 wherein the first protective tongue-like extension slides under the protective forearm guard.

6. A protective pad according to claim 2 wherein the first protective tongue-like extension slides over the protective forearm guard.

7. A protective pad according to claim 1 wherein a first protective tongue-like extension is provided on the upper arm section and a second protective tongue-like extension is provided on the protective forearm guard.

8. A protective pad according to claim 7 wherein the second protective tongue-like extension passes into or continues in padding of a hand guard.

9. A protective pad according to claim 1 wherein the upper arm section is formed as a protective upper arm guard.

10. A protective pad according to claim 1 wherein the protective tongue-like extension is easily flexible.

11. A protective pad according to claim 1 wherein the protective tongue-like extension slides under the protective forearm guard.

12. A protective pad according to claim 11 wherein the protective forearm guard possesses a tunnel-like concavity.

13. A protective pad according to claim 1 wherein the protective tongue-like extension slides over the protective forearm guard.

14. A protective pad according to claim 13 wherein the protective forearm guard possesses a guidance device.

15. A protective pad according to claim 14 wherein the guidance device is formed as a rail-like recess.

16. A protective pad according to claim 13 wherein the tongue-like extension possesses a slide-like fitting.

17. A protective pad according to claim 1 wherein inherent arching of the protective tongue-like extension is less than arching of the upper side of the forearm in the most extended position.

18. A protective pad according to claim 1 wherein the protective tongue-like extension and the protective forearm guard are connected to one another by an elastic strap.

19. A protective pad according to claim 1 made of an ethylene/vinyl acetate copolymer.

20. A protective pad for the upper arm and forearm of a person, particularly of an athlete, comprising:

an upper arm section, and a forearm guard, wherein at least one of the upper arm section and the forearm guard possesses a tongue-like extension, and wherein the inherent arching of the tongue-like extension is less than the arching of the upper side of the forearm in the most extended position.

21. A protective pad according to claim 10, wherein the easily flexible protective tongue-like extension is a soft foam protective pad.

* * * * *